United States Patent [19]

Williams

[11] 4,105,148

[45] Aug. 8, 1978

[54] SELF-VENTING SPOUT

[75] Inventor: William D. Williams, Mahwah, N.J.

[73] Assignee: Sterling Drug, Inc., New York, N.Y.

[21] Appl. No.: 734,411

[22] Filed: Oct. 21, 1976

Related U.S. Application Data

[63] Continuation-in-part of Ser. No. 546,329, Feb. 3, 1975, abandoned.

[51] Int. Cl.[2] ..... B67D 3/00

[52] U.S. Cl. ..... 222/478

[58] Field of Search ..... 222/478, 566–568, 222/479, 188, 481.5; 220/85 SP

[56] References Cited

U.S. PATENT DOCUMENTS

| | | | |
|---|---|---|---|
| 1,667,821 | 5/1928 | Rhodes | 222/478 X |
| 3,856,188 | 12/1974 | Newby | 222/541 X |

*Primary Examiner*—Stanley H. Tollberg
*Attorney, Agent, or Firm*—Charles R. Fay

[57] ABSTRACT

A self-venting spout for pouring liquids from a container without spilling and without re-entrance of air through the pouring spout interfering with smooth flow therethrough.

The self-venting spout comprises a relatively small aperture in the uppermost surface of the spout, in which aperture there is inserted in permanent relationship a relatively short tubing. The tubing extends well into the spout e.g., diametrically thereof, and also extends to a minor extent out of and above the spout, air flowing through the tubing into the interior of the container without interfering with the flow of fluid passing out the spout.

5 Claims, 3 Drawing Figures

SELF-VENTING SPOUT

This application is a continuation-in-part of Ser. No. 546,329 filed Feb. 3, 1975 now abandoned.

BACKGROUND OF THE INVENTION

It is well-known that while pouring liquid from a closed container through a spout, there is a tendency for atmospheric air to run against the flow from the outside of the spout back through the spout into the container, due to negative pressure therein. This interferes with the smooth flow of the liquid and is usually avoided by the use of an opening in the container at the top thereof allowing ambient air to enter on top of the liquid in the container thereby allowing the smooth flow outwardly thereof through an opening or through a spout. The present invention avoids the use of such an opening while at the same time allows ambient air to flow through the liquid into the top of the container without interfering with the smooth flow of fluid through the spout.

SUMMARY OF THE INVENTION

A spout is provided for any kind of container desired, said spout allowing the flow of liquid from the container to a desired location. The spout can be of any configuration desired but reference is made to design U.S. Pat. No. 182,940, May 27, 1958, disclosing a satisfactory spout of the kind described.

Adjacent to the top wall of the container to which the spout is affixed there is provided a relatively small hole or vent, say for instance ⅛ inch in diameter, at the uppermost surface of the spout, i.e., when the spout is carrying out its intended function. In this hole there is permanently fixed a short piece of tubing which extends slightly outwardly of the spout, the major portion of the tubing being located within the spout. The tubing is preferably diametrically located and the inner end of the tubing extends toward but does not touch the lower wall of the spout. The action is that as the container having the spout is tilted to pour out fluid through the spout, ambient air flows in through the atmospheric end of the tubing to the inner end thereof and then inwardly through the liquid to the top of the container. Where the vent above-described present, but the tubing lacking, the liquid would initially pour out of the end of the spout and also out of the vent simultaneously. This is unsatisfactory from a practical standpoint and the tubing prevents the flow of liquid through the vent and does so by temporarily restricting flow of liquid out the vent until sufficient negative pressure is built up in the container.

PREFERRED EMBODIMENT OF THE INVENTION

A container 10 of any description for the purpose of containing liquids is provided with a spout 12 also of any desired configuration which may be permanently or temporarily secured with relation to the top wall of the container as in the area at 14. The illustration shows the container tilted to pour.

The spout, for purposes of description, may be said to have a top wall 16 and a bottom wall 18, the liquid in the container of course flowing in the direction of the arrows A through the spout.

Figure 1:
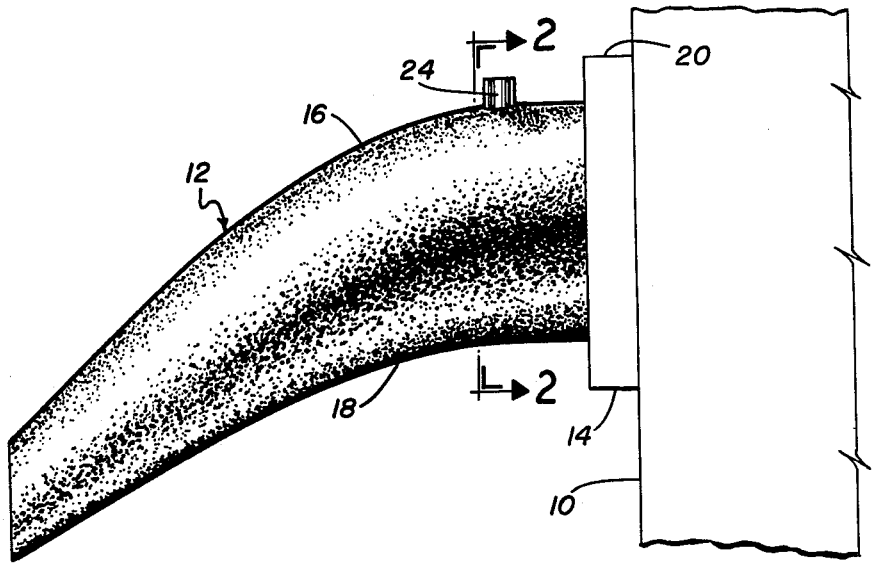
FIG. 1 is a view in elevation illustrating the invention.
Figure 2:
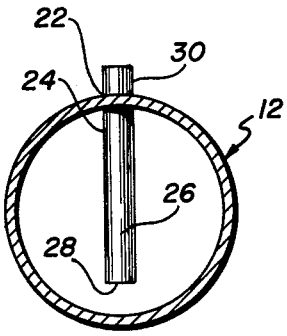
FIG. 2 is a view in cross section of the spout in lines 2—2 of FIG. 1.
Figure 3:
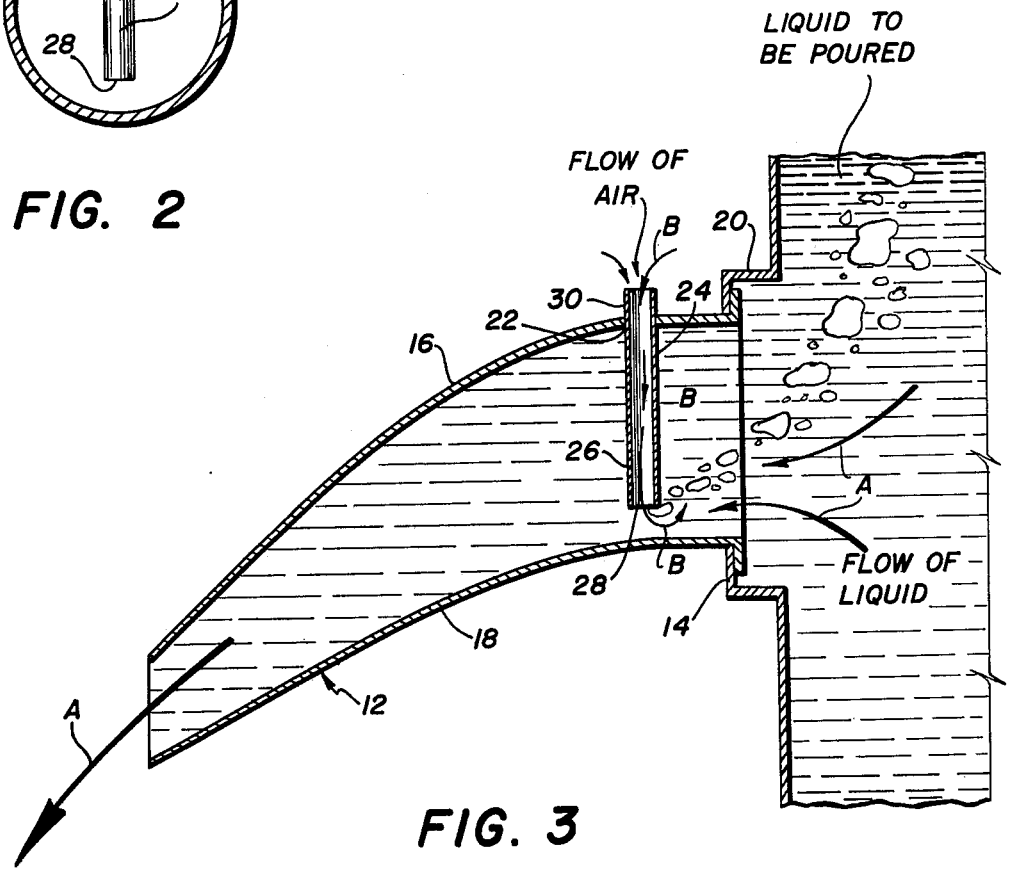
FIG. 3 is a longitudinal cross section through the spout, tubing and container.

The top wall of the spout adjacent the wall at 20 of the container 10 is provided with a relatively small opening (vent) 22 which may be for example be in the nature of ⅛ inch in diameter. A short piece of tubing 24 fitting the opening is either pressed or welded or otherwise secured therein as shown in FIGS. 2 and 3 with the major portion 26 of the tubing within the container, and having an open end 28 adjacent to but not in contact with the inner surface of the lower wall 18 of the spout.

The tubing 26 extends outwardly to the atmosphere through the top wall of the spout for a relatively minor distance as at 30.

In the use of the device, the container is tilted in the usual way to pour fluid out of the spout 12. The tubing 26 within the spout takes up a very small portion of the area thereof. With the negative pressure as usual inside the container at the top of the liquid, air tends to flow in as shown by the arrows B through the tubing and then of course upwardly through the liquid to the top of the container to obviate the negative pressure occasioned by the pouring action. This allows a free and smooth flow of liquid past the tubing and out the spout. The vent and the tubing convert the spout from an ordinary liquid flow director to a selfventing arrangement that prevents splashing and gurgling as air replaces the liquid that is being poured from the container. Without the tubing, the aperture 22 would not be practical for the purpose at hand because the liquid would initially pour out of this aperture as well as out of the spout, until the negative pressure is built up inside the container. Through the use of the short tubing this is prevented, until sufficient negative pressure is built up in the container to obviate the need therefor. Therefore it will be seen that by a very simple construction a self-venting spout is provided without the necessity of having closures and caps for other vents in the top area of the container.

I claim:

1. A self-venting spout for a closed container, said spout being attached with respect to a wall of the container, said spout having a pair of opposite walls, one of said spout walls being uppermost when the container is turned in order to pour material through the spout, and the other spout wall being lowermost, a vent in the uppermost spout wall, a piece of substantially straight tubing associated therewith and extending for a short distance out into the atmosphere through said vent and for a major portion of its length into and across for a major part of the diameter of the spout, approaching the lowermost wall and terminating short thereof, said spout having a pouring orifice, and the vent being remote from the orifice.

2. The spout of claim 1 where the vent and the tubing are positioned in closely spaced relation to said container wall.

3. The spout of claim 1 wherein the tubing is located diametrically in the spout.

4. A self-venting spout for a closed container, said closed container including a plurality of walls and being otherwise closed, said spout being attached to a wall of the container and extending therefrom, said spout including a tubular member with a pouring orifice, a vent in said tubular member adjacent the wall to which the spout is attached and remote from the pouring orifice, a piece of tubing in said vent and extending a short distance out of said tubular member into the atmosphere and through said vent and into the tubular member for a portion of its length diametrically across said tubular member, approaching the side of said tubular member opposite the vent but terminating short thereof, the portion of the tubing in the tubular member extending across the latter for the major portion of its length.

5. The spout of claim 4 wherein the tubular member tapers from a maximum diameter adjacent the wall to which the spout is attached to a minimum at the pouring end thereof, the tubing being located in the area of maximum diameter.

* * * * *